US005582218A

United States Patent [19]

Beale

[11] Patent Number: 5,582,218

[45] Date of Patent: Dec. 10, 1996

[54] DISPENSING SYSTEM FOR REFUELING TRANSPORT CONTAINERS WITH CRYOGENIC LIQUIDS

[75] Inventor: Jeffrey P. Beale, CH-IV Corporation, 599 Canal St., Lawrence, Mass. 01840

[73] Assignee: Jeffrey P. Beale, Andover, Mass.

[21] Appl. No.: 501,371

[22] Filed: Jul. 12, 1995

Related U.S. Application Data

[62] Division of Ser. No. 250,388, May 27, 1994.

[51] Int. Cl.[6] ..... B67D 5/00

[52] U.S. Cl. ..... 141/3; 141/5; 141/21; 141/18; 141/49

[58] Field of Search ..... 141/2–5, 18, 21, 141/44, 45, 47, 49–51, 83, 95, 197, 198

[56] References Cited

U.S. PATENT DOCUMENTS

| | | | |
|---|---|---|---|
| 3,272,238 | 9/1966 | Groppe | 141/5 |
| 3,282,305 | 11/1966 | Antolak | 141/5 |
| 4,351,372 | 9/1982 | Delgado | 141/2 |

*Primary Examiner*—J. Casimer Jacyna

[57] ABSTRACT

A system for the automatic filling of cryogenic containers such as fuel tanks. A cryogenic fluid having a vapor phase at positive pressure is removed by a control mechanism and transported to a primary storage tank through a single phase transport line. When the pressure in the fuel tank is reduced to an acceptable level, liquid cryogen is automatically pumped from the primary storage container to the fuel tank through the same single phase transport line.

2 Claims, 2 Drawing Sheets

DISPENSING SYSTEM FOR REFUELING TRANSPORT CONTAINERS WITH CRYOGENIC LIQUIDS

This is a division of appplication Ser. No. 08/250,388, filed May 27, 1994.

FIELD OF THE INVENTION

This invention relates to an automated dispensing system for the controlled removal of vapor and the controlled delivery of cryogenic fuel into vehicles using a single phase transport line.

BACKGROUND OF THE INVENTION

Systems for the refueling of transportation vehicles powered by cryogenic liquids face a variety of design challenges primarily due to the problems associated with using cryogenic liquids. Insulated containers designed to handle cryogens experience some degree of heat absorption. Tanks containing residual quantities of liquid cryogen, can easily generate boil off vapor during storage or during refueling due to the heat present in the piping or tanks. In some circumstances, the vapor pressure can exceed the maximum allowable operating pressure of the tank design or maximum available transfer pressure available from a dispenser system.

Boil-off vapor from cryogens such as liquid natural gas (LNG), may include gasses such as methane which are condensable back into reusable liquid phase by exposure to the excess cold available in LNG. Other boil-off gasses such as nitrogen, do not condense as easily and may accumulate above the liquid phase level during the refueling cycle. If not vented, increase tank pressure occurs as the liquid phase rises.

The process of refueling containers with LNG has traditionally been accomplished by the use of a two line system where one line conduits vapor away from the fuel tank and a second conduit carries the liquid phase for refueling the tank. The process requires either the use of two lines and two nozzles or a single coaxial line. A coaxial line is both cumbersome and requires a coaxial connection to the vehicle which has high maintenance requirements.

While there has been some work with single hose dispensing systems, the systems do not provide for the depressurization of the fuel tank or the venting of non-condensable gases without the connection of a second smaller cryogenic vent line.

In those systems which require the operator to determine the tank conditions through external mounted gauges, operator error is compounded by frost encrusted line gauges and mechanical damage to the sensors due to excessive vibration and harsh conditions associated with normal vehicle usage. In addition, the operators, for the most part, may have not received extensive training in the handling of cryogenic materials and as such, the connection and disconnection of conduit lines and the dependence on external gauges presents an unnecessary risk to the operator, equipment, and facility.

A variety of methods have been suggested which regulate the vapor phase pressure in tanks by mechanical vent valves which are calibrated to release vapor when a setpoint pressure has been reached. None of these methods utilize a reliable system which reduces the risk of operator error.

In addition to mechanical control mechanisms, a variety of semiautomated systems are known. For example, U.S. Pat. Nos. 5,231,838 and 5,121,609 disclose single line fueling stations for liquid natural gas vehicles where an operator manually controls the venting of vapor phase from a fuel tank to the head gas in a pressure building tank and the delivery of liquid phase gas from the pressure building tank to the vehicle fuel tank by a single line. The systems require a separate liquid nitrogen cooling system to regulate the pressure in the pressure building tank to insure that adequate pressure is available to deliver a desired quantity of liquid natural gas to a vehicle fuel tank.

U.S. Pat. No. 4,080,800 discloses a mechanical control mechanism in which liquid and vapor phases are simultaneously removed from a holding tank through a flow control valve for ultimate utilization as a fuel source.

In U.S. Pat. No. 3,298,186 a refrigeration method is disclosed whereby the ethane content of a refrigerated propane liquid stored in a container is maintained by condensing a portion of the vapors generated from the container and returning the condensate to the container. This method utilizes a co-mingled two phase line for the purpose of reducing the ethane vapor by absorption into the liquid.

One object of the present invention therefore is the controlled removal of vapor and the controlled delivery of single phase liquid cryogen by the use of a single line;

Another object of the present invention is the rapid delivery of liquid cryogen to a variety of transportable fuel tanks having different volumes by a system which is simple to operate;

A further object of the present invention is to provide a refueling system which can deliver desired quantities of cryogenic liquid on demand without requiring the transfer of additional cryogenic liquid for cool down of the lines. A simple system which meets these objects would be a useful advancement in the art of cryogenic fuel delivery systems.

Accordingly, the present invention relates to a system for the automatic refueling of cryogenic containers such as are found in LNG powered vehicles. The system includes as component parts, a primary storage tank and a fuel tank wherein the fuel tank may contain a residual quantity of liquid phase cryogen and also a vapor phase at a positive pressure. The system also includes a dispensing unit which further comprises means for measuring the pressure of the vapor phase, means for calculating the level of the liquid phase in the tank, and means for transporting the vapor phase from the fuel tank to the primary tank and liquid phase from the primary tank to the fuel tank. Also contemplated is a control means for regulating the vapor phase pressure and liquid phase level in the fuel tank.

In operation a single phase transport line is connected to the fuel tank containing residual vapor at a positive pressure and a liquid phase. Values for the fuel tank vapor pressure and liquid phase level are determined at constant time intervals and compared against desired values. If pressure in the tank is above a desired maximum value the pressure is reduced to an acceptable level by transporting the vapor phase to the primary storage tank where the vapor is condensed in the residual liquid minimizing pressure growth in the primary tank. Liquid phase cryogen, is then pumped into the fuel tank and regulated to a desired fill level.

In one embodiment, the operation may be accomplished automatically without requiring any operator involvement thereby reducing the risk of either under filling or over filling the fuel tank due to operator misreading of vehicle based sensor gauges.

Another advantage of the present invention is realized by the elimination of a cool down cycle where LNG is pumped through the lines on pump start up to cool the lines to an acceptable temperature to eliminate flashing and excessive vapor production.

BRIEF DESCRIPTION OF THE DRAWINGS

These and other objects and advantages will be further clarified by the following brief description of the Figures in which.

DETAILED DESCRIPTION OF A PREFERRED EMBODIMENT

Figure 1:
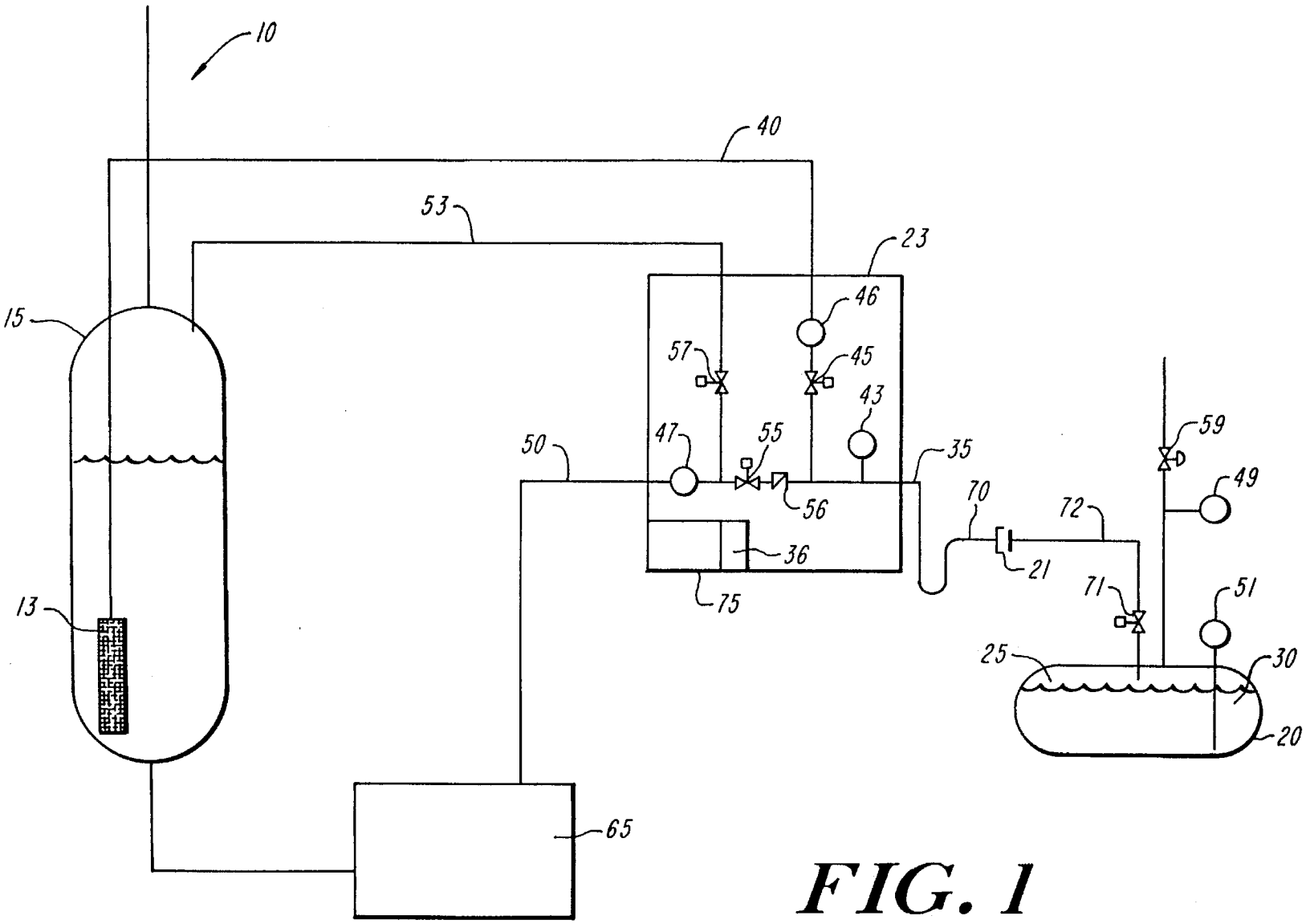
FIG. 1 is process flow sheet of the automatic refueling system of the present invention.

Accordingly, FIG. 1 discloses a system 10 for the automatic filling of cryogenic fuel containers. Included in the system is a primary storage tank 15 and fuel tank 20 which contains a quantity of liquid phase cryogenic liquid 30 and vapor 25. Dispensing unit 23 is contemplated which includes sensor means 43 provided in the dispenser line 35 or alternatively, in the single phase transport line 70 for determining values for the vapor phase pressure 25 and the level of liquid phase 30. In one embodiment, dispensing line 35 is composed of metal or metal alloy and single line 70 is of a flexible material or an articulated solid line having the capability of movement. In yet another embodiment a vapor and fluid pressure sensor 43 is used which automatically transmits values continuously at constant intervals of time.

The dispensing unit 23 further includes transport means for carrying the vapor phase from the fuel tank 20 to the primary storage tank 15 and liquid phase from the primary tank 15, to the fuel tank 20. While not wishing to be limited to any particular cryogenic liquid, reference hereafter shall be to liquid natural gas (LNG) for purposes of convenience.

With the variability of fuel requirements for vehicles serviced by the present invention, it is important to recognize that fuel tank 20 is not necessarily limited to any particular volume. Generally, the tanks are insulated by known means to accommodate cryogenic liquids and provide on board pressure and liquid level measurements to the driver. In addition to emergency vent valves 59 for releasing pressures in excess of the maximum tank operating pressure, the tank 20 contain ports for fuel delivery and may contain an automatic shut off valve 71 which prevents fuel entering the tank once a desired capacity is achieved.

The transport means of the present invention may include a dispensing line 35, a first line 40 for transporting vapor phase, a first valve 45 connected to first vapor line 40 and dispensing line 35, a second line 50 for transporting liquid phase fuel, a second valve 55 connected to the second liquid fuel line 50, a recirculating line 53 connected to the primary tank 15, a check valve 56 separating second line 50 and line 53 from dispensing line 35, a third valve 57 connected to second line 50 at one end and recirculating line 53 at the other, and a pressure delivery assembly 65. The present invention also contemplates that the pressure delivery assembly 65 may include one or more tanks where vapor pressure is used to circulate liquid phase throughout lines 50, 53, 35, and 70. In a preferred embodiment, a variable speed pump is used. A single phase transport line 70 is also contemplated which is connected at one end to the dispensing line 35 and may be removably connected to the fuel tank 20 by connector 21 via fuel line 72.

The dispensing unit 23 further includes a control means 75 for regulating the pressure of the vapor phase, liquid phase level, and controlling the pump. In one embodiment the control means comprises means for generating and receiving signals (not shown) which directly reflects the vapor phase pressure and indirectly reflects the fuel level. In particular, sensor means 43 may be pressure transmitters which are commercially available through Foxboro Corporation. In yet a further embodiment turbine flow meter 46 and 47 commercially available through Hoffer Flow Controls, Inc., of Elizabeth City, N.C. may also be employed to provide control means 75 with feed back on vapor flow and pump performance between the fluid pumping cycle and recirculation cycle. In an alternate embodiment, fuel tank 20 may include pressure transmitters 49 and fluid level transmitters 51 which do not require connection to the dispensing unit 23, and fuel line switch means 36.

A computer means 75 is used for comparing the measurements received by first input signals for pressure in the dispensing line 35 against desired maximum pressure values and the change in pressure measurements for a given increment of time against desired mid range and maximum pressure values for the same time period. The selection of the maximum pressure values and the mid range and maximum values for the rate in pressure change will be inputted by an operator into the controller 75 and be selected in accordance with the cryogenic liquid being filled into fuel tank 20. While a variety of suitable process controlling devices will be known to those skilled in the art, controllers produced through Fisher Controls, of Marshall Town, Pa. may be used. Means for generating and receiving output signals (not shown) which reflect the comparison of pressure measurements are also contemplated. The signals, reflecting the comparison of pressure measurements are used to set initial pressure and LNG flow values to zero, to open and close first valve 45, second valve 55, and third valve 57, and to regulate the pump assembly 65, collectively, when the system moves from a standby state to venting and filling of the fuel tanks. In order to prevent the vented gas from traveling into recirculating line 53 first valve 45, check valve 56, valve 55, and third valve 57 are under standby conditions; with the first valve being open; the second valve being closed; and the third valve being open. In another embodiment, computer means 75 performs a diagnostic check of the valve and pump assembly status on a predetermined interval basis and at least prior to release of vapor pressure from the fuel tank into the dispensing line and the delivery of liquid fuel into the system. For example, prior to venting a fuel tank, a first output signal is generated by the computer means 75 to open or close the valves where the first input signals generated by the valves indicate an undesirable valve state.

In one embodiment, connection of the dispensing line to the fuel tank activates an automatic switch means 36. The computer means 75 generates a first output signal to close the first valve 45 so that the pressure in the dispensing line may be determined.

In another embodiment, vapor from the fuel tank is transported by line 40 to primary tank 15 where the vapor is recondensed into liquid by passing through dispersion means 13 located in the primary tank 15.

The type of pump used is based in part on the minimum flow requirements of the LNG recirculation cycle and the maximum pressure head requirements necessary to deliver fuel to a variety of fuel tank designs. Generally, pumps produced from Ebara International Corporation, of Sacramento, Calif. which delivery at least 125 psi and a flow of up to 30 gpm may be used.

The present invention further contemplates a method of operation wherein after a single phase transport line 70 is connected to a fuel tank line 72 at 21 and dispensing line 35, at least the vapor phase pressure in said fuel tank is determined by direct measurements of vapor pressure. Both during the venting and fill cycles, direct pressure measurements are taken of the pressure in dispensing line 35 at 43, continuously over a constant interval of time.

First input signals reflecting the initial measured pressure values are compared against standby conditions where pressure values in the dispensing line are at or about ambient pressure conditions. Input signals reflecting subsequent measurements are compared against desired maximum values for vapor phase pressure desired maximum and mid range values for the rate of pressure change. The vapor phase pressure and liquid phase level in the fuel tank 20 are regulated in accordance with the values obtained by the comparison by means of a single phase transport line 70.

A method of the present invention is more particularly described as continuously circulating LNG from the primary storage tank 15 through pump 65, fluid line 50, recirculating line 53 and finally back to primary tank 15. The pumping assembly 65 will operate in a standby mode at minimum pressure and flow rate necessary to maintain fuel transport lines at a temperature sufficient to prevent two-phase flow. While in standby mode, first valve 45 is maintained in an open position and second valve 55 is maintained in a closed position to vent any pressure buildup as vapor into primary tank 15 and prevent flow of recirculating LNG from entering dispensing line 35. Third valve 57 remains in an open position to permit recirculation of LNG. These valves stay in the stated open or closed positions unless otherwise instructed by computer means 75.

Most commercially available motor and pneumatically driven valves suitable for use with cryogenic liquids may be used.

Figure 2:
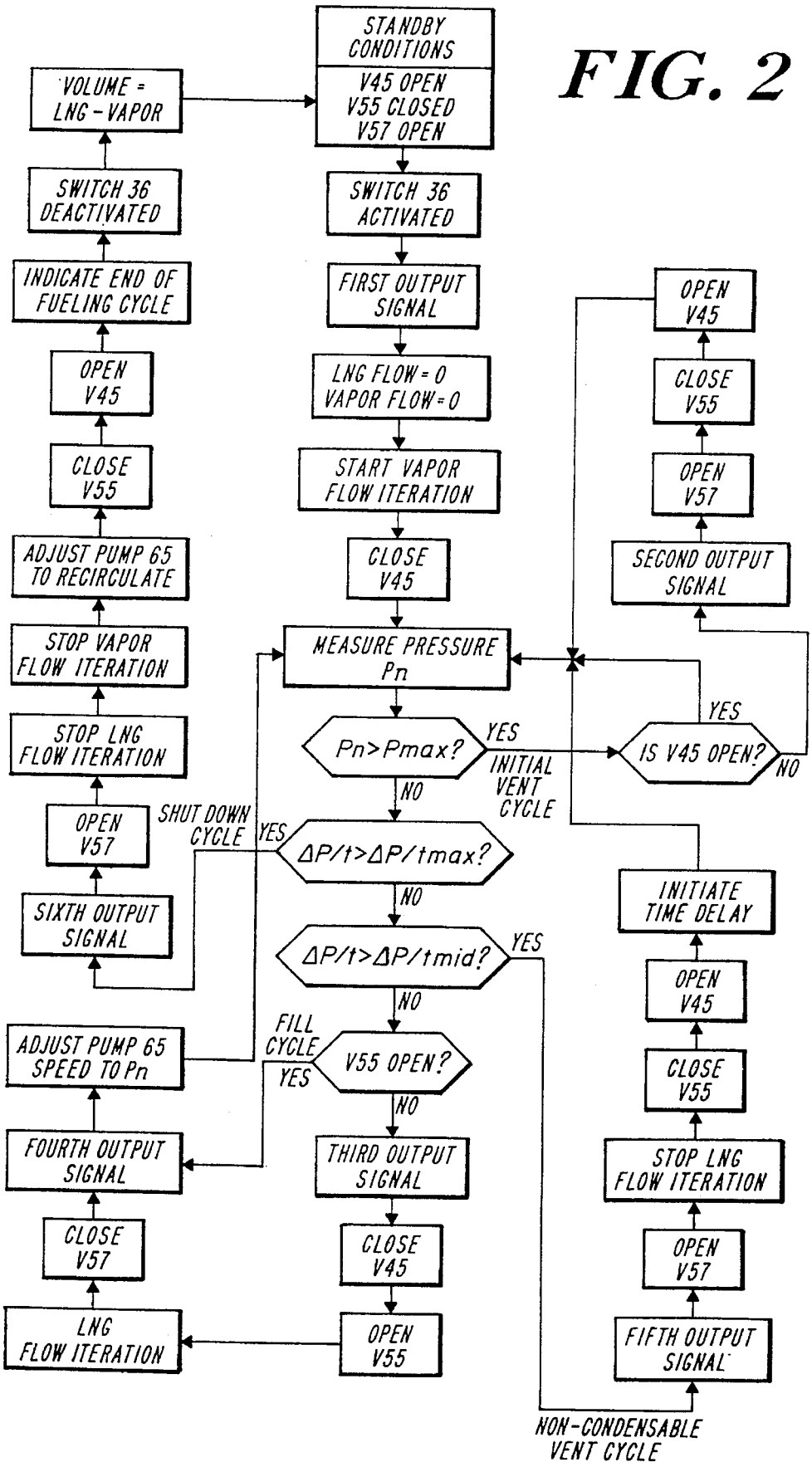
FIG. 2 is a flow sheet of the control mechanism of the present invention.

Referring to FIG. 2, the present invention contemplates that in one embodiment of the present invention, the refueling process may be initiated by means of a switch mechanism 36 which is activated automatically with the connection of single phase transport line 70 to fuel line 72, or in an alternate embodiment, through the operator manually activating dispenser switch 36. Activation of dispenser switch 36 causes computer means 75 to generate a first output signal which sets the initial flow values for LNG and vapor to zero; causes control means 75 initiates vapor flow; and causes first valve 45 to move to the closed position. After connecting the single phase transport line 70 to a fuel tank line 72, the vapor phase pressure present in the fuel tank 20 is introduced into the dispensing unit 23 and more particularly into dispensing line 35. The pressure in the dispensing line 35 is then automatically transmitted to computer means 75 at constant intervals as instructed by computer means 75.

Initial Vent Cycle

The computer means 75 compares the pressure measurement (Pn) in dispensing line 35 which is indicative of the vapor pressure in vehicle tank 20 against a desired maximum pressure value (Pmax). Where the measured pressure is greater than the desired maximum pressure, the difference calculated is indicative of the amount of vapor pressure in tank 20 which is to be communicated to tank 15 by means of line 40. As indicated above, computer means 75 conducts an automatic check on the status of the valves. Where for example, first valve 45 is closed during the initiation process prior to securing line 70 with tank 20 as discussed above, computer means 75 conducts an automatic check on the status of this valve and generates a second output signal causing valve 57 to move to the open position, causing valve 55 to move to the closed position, causing valve 45 to move to the open position, and causing the pump system to reinitiate the recirculating of LNG back to primary tank 15, thereby establishing a secure open conduit for vapor in tank 20 to be communicated to tank 15 by means of line 40.

If in successive measurements, the measured pressure (Pn) continues to be greater than the desired maximum pressure (Pmax), then venting continues in the manner discussed above until such measurement that Pn is less than or equal to Pmax.

Fill Cycle

If in a successive measurement Pn is less than or equal to Pmax then computer means 75 calculates a rate of change in pressure from the previous measurement ($\Delta P/t$) by subtracting the previous pressure measurement from the current measurement and dividing that result by the time interval. The computer means 75 compares $\Delta P/t$ against a desired maximum rate of change value ($\Delta P/t$ max). $\Delta P/t$ max is indicative of the pressure rise realized when tank 20 has reached a full condition. Fuel flow may be stopped either by means of a switch mechanism 51 which automatically activates valve 71 or through tank 20 reaching a full condition. In either case further flow of LNG into fuel tank line 72 is prevented.

Providing $\Delta P/t$ max has not been attained, the computer means 75 next compares $\Delta P/t$ against a predetermined midrange rate of pressure change ($\Delta P/t$ mid). $\Delta P/t$ mid which is indicative of the collection of non-condensable gases which have accumulated in the vapor space of tank 20.

Having established that Pn is less than or equal to Pmax and $\Delta P/t$ is less than both $\Delta P/t$ max and $\Delta P/t$ mid then computer means 75 conducts an automatic check on the status of the valve 55. Computer means 75 generates a third output signal which causes valve 45 to move to the close position, causes valve 55 to move to the open position, initiates the filling cycle of LNG, and causes valve 57 to move to the close position.

Computer means 75 next generates a fourth output signal which calculates the proper speed of pump 65 to achieve discharge pressure adequate to overcome Pn and deliver an adequate flow through dispensing unit 23 and into vehicle tank 20.

If in successive measurements, the measured pressure (Pn) continues to be less than or equal to Pmax and $\Delta P/t$ is less than both $\Delta P/t$ max and $\Delta P/t$ mid, the filling cycle continues.

Non-Condensable Vent Cycle

If in successive measurements, the measured pressure (Pn) continues to be less than or equal to Pmax and $\Delta P/t$ is less than $\Delta P/t$ max but greater than $\Delta P/t$ mid, which is indicative of the collection of noncondensable gases which have accumulated in the vapor space of tank 20, computer means 75 generates a fifth output signal which causes third valve 57 to move to the open position, initiates standby conditions for the pump assembly, causes second valve 55 to move to the close position, causes first valve 45 to move to the open position, and initiates a time delay before returning to measure Pn. The time delay provides adequate time to vent the non-condensable gases from fuel tank 20. The length of the time delay will be known to those skilled in the art and will be determined in part as the volume and pressure of the non-condensable gasses.

Shut-Down Cycle

If in successive measurements, the measured pressure (Pn) continues to be less than or equal to Pmax but ΔP/t is greater than ΔP/t max, computer means 75 generates sixth output signal which causes third valve 57 to move to the open position, which causes LNG filling to discontinue, which causes vapor transport to discontinue. The speed of pump 65 is regulated to return to the standby recirculation flow rate. Second valve 55 is caused to move to the close position and first valve 45 is caused to move to the open position. In one embodiment an audible and/or visual signal indicates the refueling cycle has been completed.

The present invention contemplates that the refueling process is terminated by means of a switch mechanism 36 which is de-activated automatically on uncoupling of the single phase transport line 70 or through the operator manually de-activating dispenser switch 36. Dispenser switch 36 de-activation causes computer means 75 to generate seventh output signal that calculates the dispensed fuel volume by subtracting the volume of vapor flow from the volume of LNG flow.

I claim:

1. A method for the automated filling of fuel tanks with a cryogenic liquid comprising:

initiating standby conditions;

connecting a single phase transport line to a fuel tank containing residual cryogen vapor at a positive pressure, determining values for at least vapor pressure and the rate of change in vapor pressure in said transport line at constant intervals of time;

initiating filling of the fuel tank with cryogenic fuel;

comparing said determined values for vapor pressure and the rate of change in vapor pressure against desired values, and regulating said vapor phase pressure and liquid phase level in said fuel tank in accordance with said comparison by means of said single phase transport line.

2. A method for the automated filling of fuel tanks with a cryogenic liquid comprising:

initiating standby conditions;

connecting a single phase transport line to a dispensing line and a fuel tank containing residual cryogen vapor at a positive pressure, determining values for at least vapor phase pressure and the rate of change in vapor pressure in said dispensing line at constant intervals of time;

initiating filling of the fuel tank with cryogenic fuel;

comparing said determined values against desired maximum values for vapor phase pressure and desired mid range and maximum values for rate of pressure change;

generating output signals in accordance with said compared values; and regulating said vapor phase pressure and liquid phase level in said fuel tank in accordance with said output signals by means of said single phase transport line.

* * * * *